United States Patent [19]

Kihlberg et al.

[11] 4,298,057

[45] Nov. 3, 1981

[54] TUBULAR HEAT-EXCHANGER

[75] Inventors: Yngve R. Kihlberg, Akarp; Johan E. P. Sjöholm, Bjärred, both of Sweden

[73] Assignee: Kommanditbolaget United Stirling AB & CO, Malmo, Sweden

[21] Appl. No.: 27,809

[22] Filed: Apr. 6, 1979

[51] Int. Cl.[3] ..... F28F 9/22; F28F 7/10

[52] U.S. Cl. ..... 165/159; 60/517; 165/10

[58] Field of Search ..... 165/4, 10, 159; 123/122 A, 122 AA, 545, 546, 547; 60/517, 526; 62/6

[56] References Cited

U.S. PATENT DOCUMENTS 976,237 11/1910 Westmacott ..... 123/122 A
2,670,185 2/1954 Schorner et al. ..... 165/159 X
2,963,871 12/1960 Meijer ..... 62/6
3,166,911 1/1965 Meijer ..... 60/526 X

FOREIGN PATENT DOCUMENTS 151614 9/1950 United Kingdom ..... 165/159

*Primary Examiner*—Samuel Scott
*Assistant Examiner*—Theophil W. Streule, Jr.
*Attorney, Agent, or Firm*—Finnegan, Henderson, Farabow, Garrett & Dunner

[57] ABSTRACT

In a cross flow tubular heat exchanger the tubes are arranged in a space between two concentrically, imaginary cylinders. Radially extending baffle plates ensure that the heat exchanging medium flowing outside the tubes and perpendicular to their direction will pass the central cylindrical space without tubes.

6 Claims, 2 Drawing Figures

TUBULAR HEAT-EXCHANGER

BACKGROUND OF THE INVENTION

This invention relates to a tubular heat-exchanger of the kind (herein called "the kind defined") comprising a plurality of parallel tubes through which a first fluid flows and which are disposed in a space or chamber through which a second fluid flows around the tubes and generally in directions substantially perpendicular or transverse to the tubes.

A heat-exchanger of the kind defined may be used, for example, as a cooler in a hot gas engine, in which case the first fluid is helium or other working gas and the second fluid is water or other cooling liquid.

Usually when a heat-exchanger of the kind defined is in use as a cooler in a hot gas engine the tubes connect a regenerator unit with a cold gas duct leading to a low temperature variable volume chamber in which working gas is compressed at a low temperature. The regenerator unit is arranged between the cooler and a heater head in which the working gas is heated. During operation of the hot gas engine the working gas flows to-and-fro through the cooler, the purpose of which mainly is to remove the heat developed in the working gas during the compression thereof in the low temperature variable volume chamber.

All the volumes occupied by working gas in a hot gas engine, except the variable volume chambers, should be as small as possible. Therefore, the cooler should be compact and efficient and all tubes in the cooler should be exposed to practically the same cooling effect.

The flow of cooling liquid should therefore be substantially uniform across a cross-section of the assembly of tubes in the cooler. The cross-section of the cooler should show a distribution of the tubes which is rotationally symmetrical, because the working gas flow through the cooler also should be evenly distributed among the tubes.

The present invention is therefore intended to facilitate the provision of a heat-exchanger of the kind defined such that a cooling liquid will pass around and between the tubes substantially transversely to and in contact with all the tubes at sufficient velocity to ensure a satisfactory cooling effect, so that the heat-exchanger can be suitable for use as a cooler in a hot gas engine.

SUMMARY OF THE INVENTION

According to the invention a heat-exchanger of the kind defined is characterised in that the tubes are regularly and evenly distributed around a central axis parallel to the direction of the tubes, the latter being located within a ring-shaped zone having a cross-sectional area of which the inner diameter is at least 25 percent of the outer diameter, and that there are two baffle plates each protruding radially inwards from walls bounding the space or chamber in which the tubes are disposed.

Preferably the tubes extend through end covers, which may be interconnected by rods or other bracing means outside the ring-shaped zone and/or by a central pillar or other bracing element.

It is advantageous if the baffle plates are planar and co-planar and disposed diametrically opposite to each other, and each baffle plate extends from one end cover to the other end cover.

How the invention may be put into practice is described in more detail below with reference to the accompanying schematic drawings, in which

DESCRIPTION OF THE PREFERRED EMBODIMENT

Figure 1:
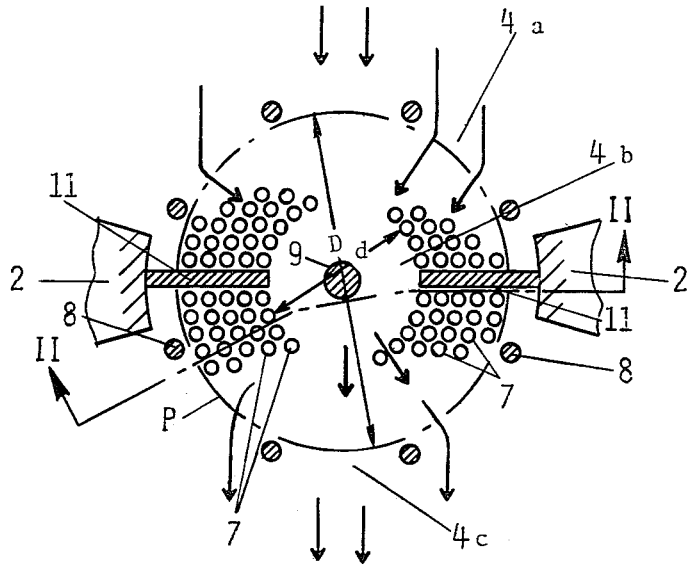
FIG. 1 shows a view in cross-section along the line I—I of FIG. 2 of a heat-exchanger according to the invention.

The illustrated heat-exchanger is adapted to serve as a cooler in a hot gas engine, of which some fragmentary parts are shown.

In the engine assembly is a regenerator housing 1 secured to an engine block 2, secured to a further engine part 10. The housing 1 contains a cylindrical regenerator element 3 consisting of a porous mass of heat-absorbing material, usually stacked discs or layers of metal wire gauze. Below said regenerator 3 the cooler according to the invention is arranged in a space or chamber 4 in the block 2. The cooler comprises metal disc end covers 5 and 6 interconnected by a plurality (for example about 200) tubes 7, preferably made of aluminium or light metal alloy. Only few of the tubes 7 are shown in the drawing. The tubes 7 extend through the two end covers 5 and 6, which are interconnected also by rods or bolts or other bracing means 8 located at equal distances from a bracing element shown as a centrally-mounted pillar 9. The rods 8 and or pillar 9 may be omitted if the tubes 7 provide sufficient mechanical strength.

As shown in FIG. 1 two baffle plates 11 are mounted in radially disposed planes, and they extend axially between the end covers 5 and 6, thus separating the cooling fluid inlet from the outlet and forcing the fluid to pass through a central zone having the diameter d.

The tubes 7 are regularly and evenly distributed within a ring-shaped zone with an imaginary right-cylindrical periphery P and having a cross-sectional area with the inner diameter d and an outer diameter D. The inner diameter d is at least 25% of the outer diameter D, and in the embodiment shown the inner diameter d is 50% of the diameter D. Each of the baffle plates 11 extends through the annular zone containing the tubes 7 and ceases at the inner diameter d. As shown, the baffle plates 11 protrude radially inwards from walls formed by the engine block 2 and bounding the space or chamber 4. The baffle plates 11 are planar and co-planar and disposed diametrically opposite to each other.

Figure 2:
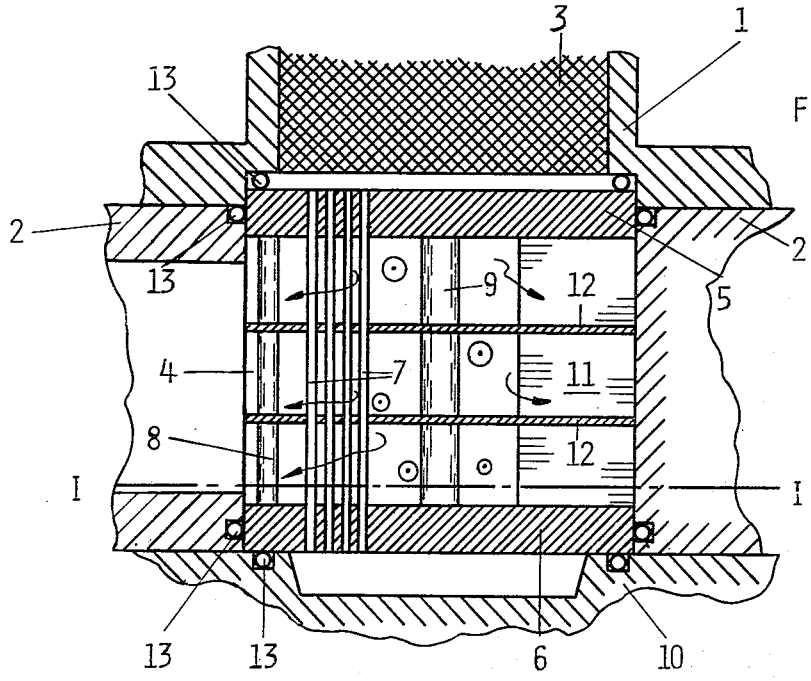
FIG. 2 shows a view in section along the line II—II of FIG. 1.

FIG. 2 shows two planar discs 12 which serve to brace or support the tubes 7. The discs 12 are perpendicular to the tubes 7 and spaced from one another and from the ends of the tubes 7.

Seals 13 made of rubber or plastic material serve to prevent leakage of gas and cooling fluid.

The described cooler will operate at follows: The tubes 7 contain working gas to be cooled and are surrounded by a flow of cooling fluid indicated by arrows in FIG. 1. The space or chamber 4 contains cooling fluid of different pressures in different zones; thus in the zone **4*a* at the top of FIG. 1 a higher pressure prevails. A medium pressure prevails in the middle zone 4*b* at the centre of the cooler, and a lower pressure prevails in the zone 4*c* at the bottom of FIG. 1**.

It will be understood that the general direction of the flow of cooling fluid between the tubes 7 in the direction from the zone 4*a* to the zone 4*b* will be substantially radial converging in all parts of the cross-section, as these radial directions offer equal and lowest resistance to such flow.

Also the general direction of the flow of cooling fluid will be substantially radial and diverging from the zone 4*b* to the zone 4*c*, for the same reason.

Thus it will be understood that the cooling effect obtained with a generally right-cylindrical tubular cooler may be substantially uniform even with a cross-flow of cooling fluid transverse to the tubes.

In practice in a typical hot gas engine the temperature of the cooling water may be about 50 degrees centigrade before entering the heat-exchanger and 55 degrees centigrade upon leaving the exchanger. The temperature of the working gas after being cooled may be about 70 degrees centigrade. The pressure drop in the cooling water may be about 200 mm water gauge across the heat-exchanger.

The tubes 7 are preferably all equal in size and with equal spaces between them as shown, but other arrangements are possible providing that the tubes are regularly and evenly distributed in an annular zone so that there is substantially equal resistance to radial flow of fluid between the tubes all round the annular zone.

What we claim is:

1. In a tubular heat-exchanger of the kind having a plurality of parallel tubes through which a first fluid flows and which are disposed within walls defining a space or chamber through which a second fluid flows around the tubes and generally in directions substantially perpendicular or transverse to the tubes, the improvement comprising the tubes being regularly and evenly distributed around a central axis parallel to the direction of the tubes, the tubes being located within a ring-shaped zone having a cross-sectional area of which the inner diameter is at least 25 percent of the outer diameter, and the heat-exchanger includes means for radially converging the flow of the second fluid to enter and pass through the region defined by said inner diameter and then radially diverging the flow of the second fluid exiting said defined region, said converging-diverging means providing converging and diverging flow within said ring-shaped zone and including two baffle plates each protruding radially into said ring-shaped zone to about said inner diameter from the walls bounding the space or chamber in which the tubes are disposed, the second fluid entering the vicinity of the tubes past one portion of the outer periphery of said zone and exiting past a second portion of the outer periphery different from said one portion.

2. A heat-exchanger according to claim 1, wherein the tubes extend through end covers which are interconnected by rods or other bracing means arranged parallel to the tubes and outside said ring-shaped zone.

3. A heat-exchanger according to claim 1, wherein the tubes extend through end covers which are interconnected by a central pillar or other bracing element which is parallel to the tubes and co-axial with the ring-shaped zone.

4. A heat-exchanger according to claim 1, wherein the baffle plates are planar and co-planar and disposed diametrically opposite to each other.

5. A heat-exchanger according to claim 2, wherein each baffle plate extends from one end cover to the other end cover.

6. A heat-exchanger according to claim 1, wherein the tubes extend through planar discs which are perpendicular to the tubes and spaced from one another and from the ends of the tubes, said planar discs bracing the tubes.

* * * * *